US010960294B1

(12) United States Patent
Bartee

(10) Patent No.: US 10,960,294 B1
(45) Date of Patent: Mar. 30, 2021

(54) MOTIVATIONAL PHRASE ASSEMBLY

(71) Applicant: Harry Bartee, Saltillo, MS (US)

(72) Inventor: Harry Bartee, Saltillo, MS (US)

( * ) Notice: Subject to any disclaimer, the term of this patent is extended or adjusted under 35 U.S.C. 154(b) by 0 days.

(21) Appl. No.: 16/720,244

(22) Filed: Dec. 19, 2019

(51) Int. Cl.
*A63F 9/04* (2006.01)

(52) U.S. Cl.
CPC ..... *A63F 9/0406* (2013.01); *A63F 9/04* (2013.01); *A63F 9/0495* (2013.01); *A63F 2009/0408* (2013.01); *A63F 2009/0411* (2013.01); *A63F 2009/0488* (2013.01)

(58) Field of Classification Search
CPC .. A63F 9/04; A63F 9/0406; A63F 2009/0408; A63F 2009/0411; A63F 9/0495; A63F 2009/0488
USPC ..... 273/145 C, 145 D, 145 R, 146
See application file for complete search history.

(56) References Cited

U.S. PATENT DOCUMENTS 632,270 A 9/1899 Lehmann
3,356,369 A * 12/1967 Stubbmann ..... A63F 3/00006 273/145 CA
3,843,131 A * 10/1974 Stubbmann ..... A63F 3/00006 273/248
4,114,290 A * 9/1978 Cooper ..... A63F 3/0415 273/145 CA
4,152,863 A 5/1979 Kubiatowicz
D556,837 S 12/2007 Webber
7,780,166 B1 8/2010 Paxton
8,079,593 B2 12/2011 Nicely

FOREIGN PATENT DOCUMENTS

GB 361654 A * 11/1931 ..... A63F 9/0406
GB 625381 A * 6/1949 ..... A63F 9/0406

* cited by examiner

*Primary Examiner* — Benjamin Layno

(57) ABSTRACT

A motivational phrase assembly includes a housing that is positionable on a support surface. A lid is attached to the housing and the lid has an opening extending therethrough. A dome is movably disposed on the housing, the dome is depressable into a depressed position and the dome is biased into a raised position. A pair of dice is positioned within the dome such that the dice are visible through the dome. Each of the dice has indicia printed thereon and the indicia comprise a plurality of unique motivational phrases. The dice are shaken in the dome when the dome is depressed and subsequently released thereby facilitating random sides of the dice to be displayed. In this way the motivational phrases on the random sides are displayed to the user.

6 Claims, 3 Drawing Sheets

MOTIVATIONAL PHRASE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to motivational devices and more particularly pertains to a new motivational device for displaying a random pair of motivational phrases for user.

(2) Description of Related Art Including Information Disclosed Under 37 CFR 1.97 and 1.98

The prior art relates to motivational devices. The prior art discloses a dice shaker that includes a tilting table surrounded by a translucent dome. The tilting table has dice thereon for shaking the dice. The prior art discloses a variety of dice shakers that include a translucent dome and a biasing unit similar in design to that which is described in this application. In each case of the disclosure the dice have numerical indicia rather than word indicia. Additionally, the prior art discloses a dice shaker that includes a translucent dome and an electronic shaking mechanism for shaking the dice in the translucent dome.

BRIEF SUMMARY OF THE INVENTION

An embodiment of the disclosure meets the needs presented above by generally comprising a housing that is positionable on a support surface. A lid is attached to the housing and the lid has an opening extending therethrough. A dome is movably disposed on the housing, the dome is depressable into a depressed position and the dome is biased into a raised position. A pair of dice is positioned within the dome such that the dice are visible through the dome. Each of the dice has indicia printed thereon and the indicia comprise a plurality of unique motivational phrases. The dice are shaken in the dome when the dome is depressed and subsequently released thereby facilitating random sides of the dice to be displayed. In this way the motivational phrases on the random sides are displayed to the user.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
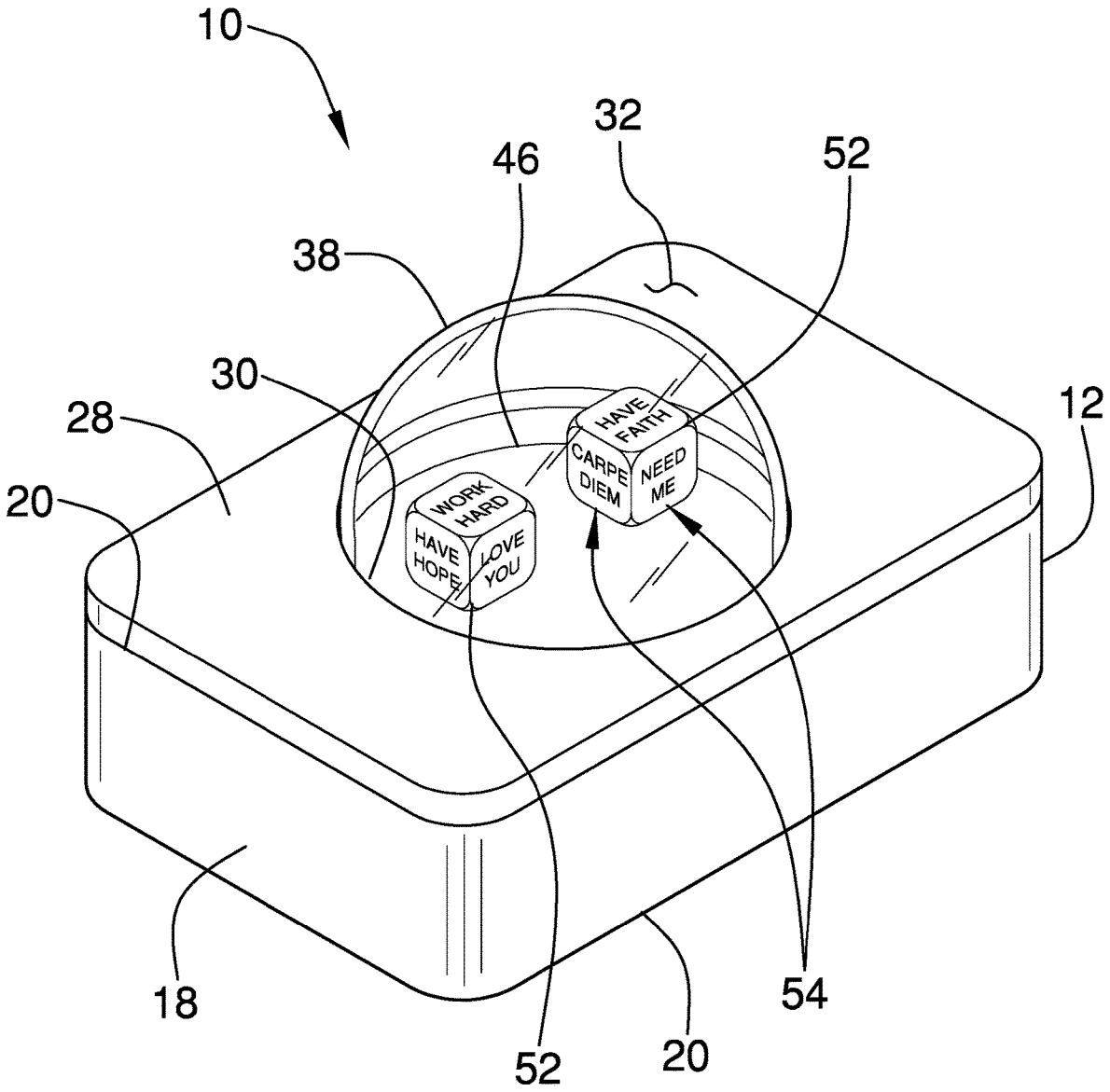
FIG. 1 is a top perspective view of a motivational phrase assembly according to an embodiment of the disclosure.
Figure 2:
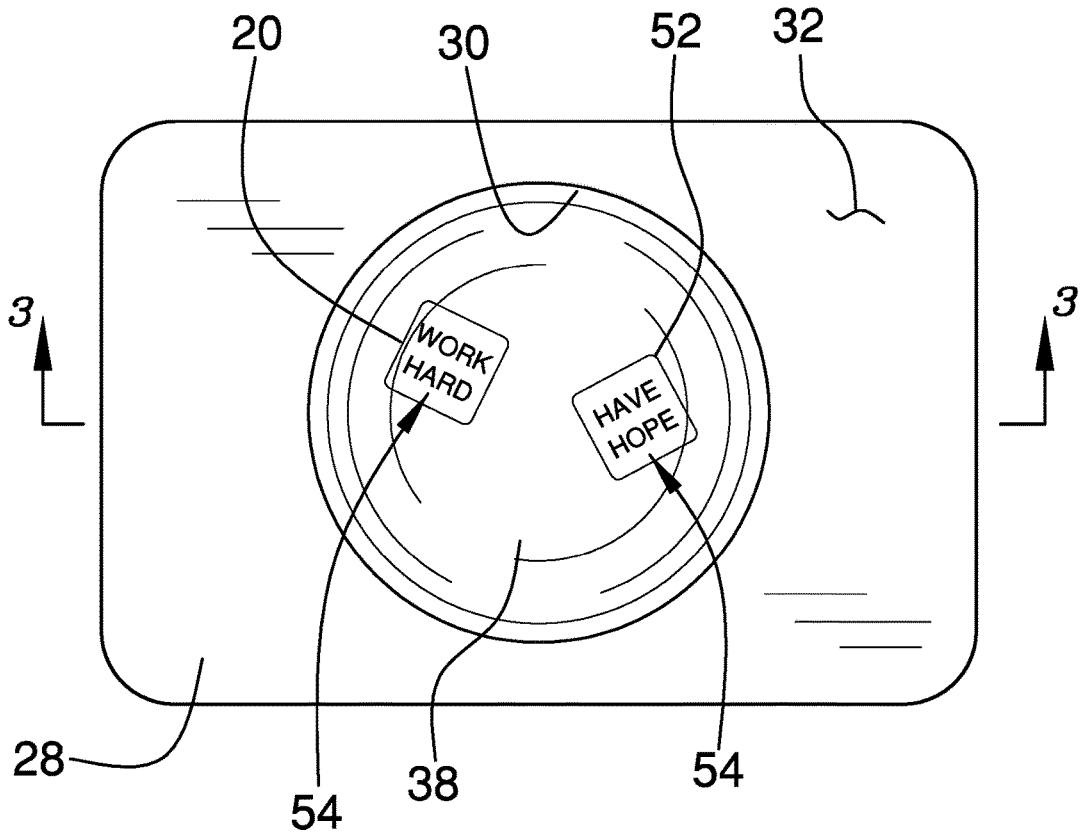
FIG. 2 is a top view of an embodiment of the disclosure.
Figure 3:
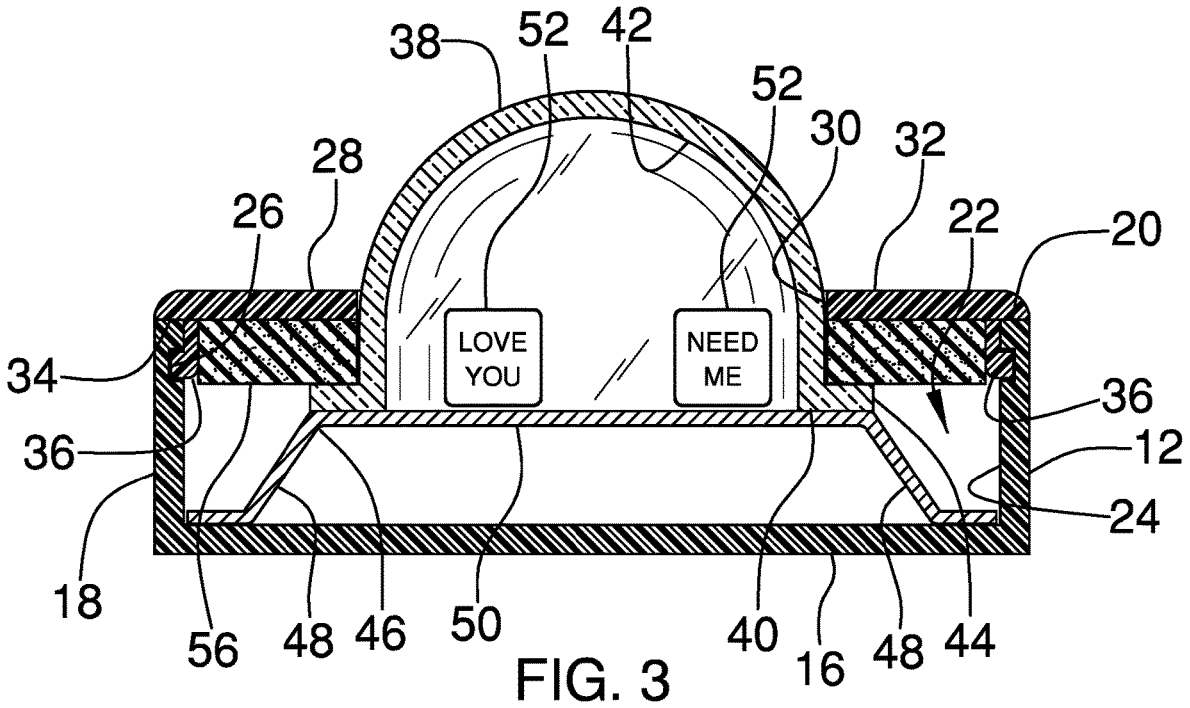
FIG. 3 is a cross sectional view taken along line 3-3 of FIG. 2 of an embodiment of the disclosure.
Figure 4:
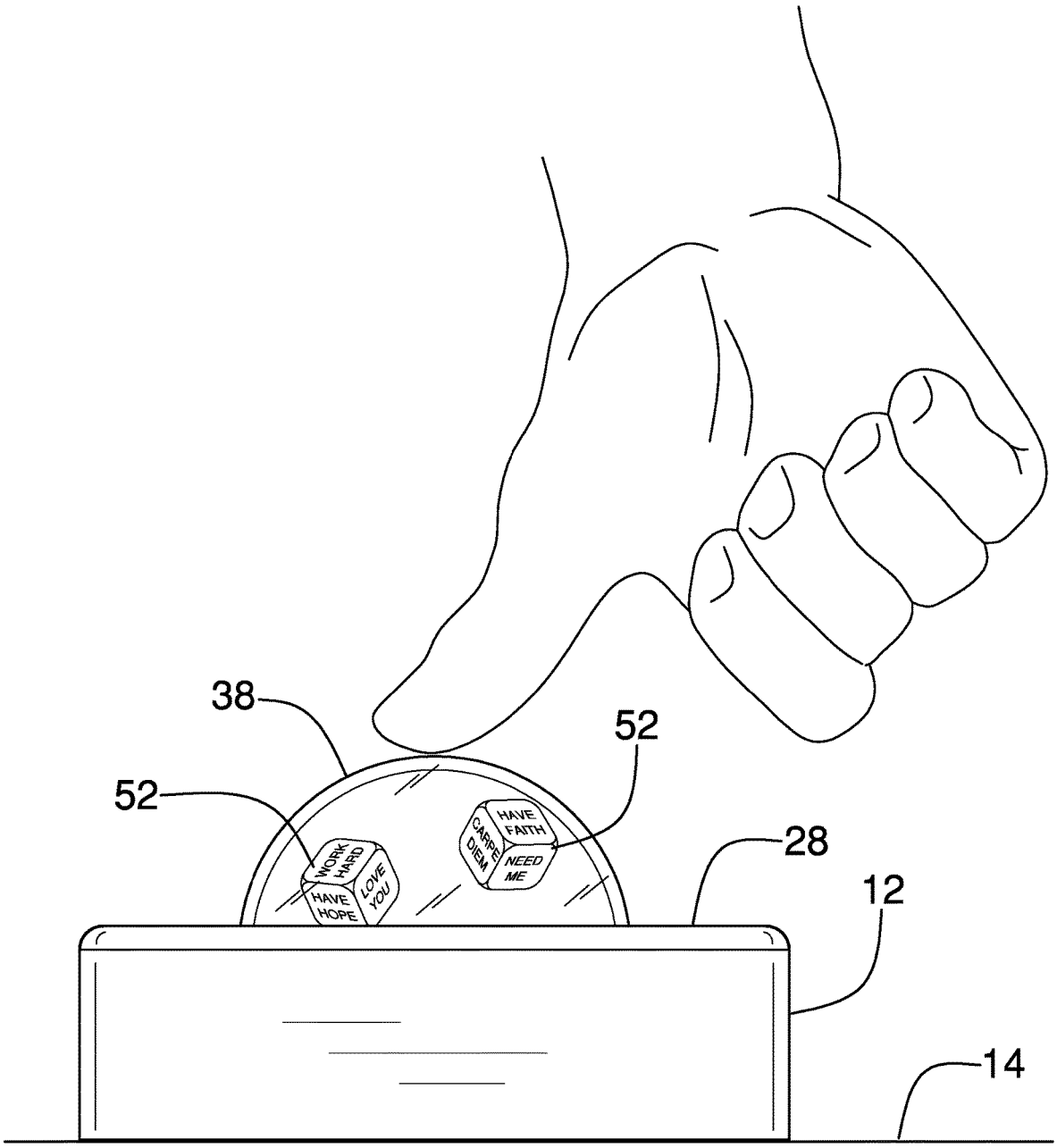
FIG. 4 is a perspective in-use view of an embodiment of the disclosure.

With reference now to the drawings, and in particular to FIGS. 1 through 4 thereof, a new motivational device embodying the principles and concepts of an embodiment of the disclosure and generally designated by the reference numeral 10 will be described.

As best illustrated in FIGS. 1 through 4, the motivational phrase assembly 10 generally comprises a housing 12 is positionable on a support surface 14. The housing 12 has a bottom wall 16 and a perimeter wall 18 extending upwardly therefrom. The perimeter wall 18 has a distal edge 20 with respect to the bottom wall 16 to define an opening 22 into the housing 12. The perimeter wall 18 has an inwardly facing surface 24 and the inwardly facing surface 24 has a groove 26 extending therein. The groove 26 is spaced downwardly from the distal edge 20 and the groove 26 extends around an entire perimeter of the perimeter wall 18.

A lid 28 is attached to the housing 12 and the lid 28 has an opening 30 extending therethrough. The lid 28 has a top surface 32 and a bottom surface 34, and the opening 30 extends through the top surface 32 and the bottom surface 34. The lid 28 includes a pair of engagements 36 and each of the engagements 36 extends downwardly from the bottom surface 34. The bottom surface 34 rests on the distal edge 20 of the perimeter wall 18 when the lid 28 is positioned on the housing 12. Additionally, each of the engagements 36 engages the groove 26 for retaining the lid 28 on the housing 12.

A dome 38 is provided and the dome 38 is movably disposed on the housing 12. The dome 38 is depressable into a depressed position and the dome 38 is biased into a raised position. The dome 38 has a lower edge 40 and an interior surface 42, and the interior surface 42 is concavely arcuate with respect to the lower edge 40. The dome 38 has a lip 44 extending outwardly therefrom and the lip 44 is aligned with the lower edge 40. The dome 38 is positioned in the opening 30 in the lid 28 having the dome 38 extending upwardly through the opening 30. Additionally, the dome 38 is comprised of a translucent material.

A biasing unit 46 is positioned within the housing 12 and the biasing unit 46 engages the dome 38. The biasing unit 46 defines a floor of the dome 38 and the biasing unit 46 biases the dome 38 into the raised position. The biasing unit 46 has a pair of legs 48 angling downwardly from a central portion 50 of the biasing unit 46. The lower edge 40 of the dome 38 rests on the central portion 50, thereby defining the floor of the dome 38, and each of the legs 48 engages the bottom wall 16 of the housing 12. The central portion 50 is urged toward the bottom wall 16 of the housing 12 when the dome 38 is depressed. Moreover, the legs 48 bias the central portion 50 upwardly toward the lid 28 when the dome 38 is released.

A pair of dice 52 is positioned within the dome 38 such that the dice 52 are visible through the dome 38. Each of the dice 52 has indicia 54 printed thereon and the indicia 54 comprise a plurality of unique motivational phrases. Additionally, each of the motivational phrases is positioned on a respective side of the dice 52. The motivational phrases may include, but not be limited to, "have faith", "work hard", "have hope" or any other motivation phrase for inspiring a user. The dice 52 are shaken in the dome 38 when the dome 38 is depressed and released thereby facilitating random sides of the dice 52 to be displayed wherein the motivational phrases on the random sides to be displayed to the user. Additionally, each of the dice 52 rests on top of the central portion 50 of the biasing unit 46.

A gasket 56 is positioned between the lip 44 on the dome 38 and the bottom surface 34 of the lid 28. The gasket 56 extends around a full circumference of the opening 30 in the lid 28. Additionally, the gasket 56 is comprised of a resiliently compressible material. The lip 44 on the dome 38 is compressed against the gasket 56 when the biasing unit 46 biases the dome 38 into the raised position. In this way the gasket 56 cushions the dome 38 against the lid 28.

In use, the dome 38 is depressed and subsequently released to shake the dice 52. Thus, the dice 52 are shaken to display the motivational phrases on randomly selected sides of the dice 52. In this way the user can view the motivational phrases that are displayed in moments of doubt or when the user simply needs an uplifting message. The dome 38 can be depressed and subsequently released multiple times in succession if the user chooses.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A motivational phrase assembly being configured to display a variety of motivational phrases for enhancing well-being in a user, said assembly comprising:

a housing being positionable on a support surface;

a lid being attached to said housing, said lid having an opening extending therethrough;

a dome being movably disposed on said housing, said dome being depressable into a depressed position, said dome being biased into a raised position;

a biasing unit being positioned within said housing, said biasing unit engaging said dome, said biasing unit defining a floor of said dome, said biasing unit biasing said dome into said raised position;

a pair of dice, each of said dice being positioned within said dome such that said dice are visible through said dome, each of said dice having indicia being printed thereon, said indicia comprising a plurality of unique motivational phrases, each of said motivational phrases being positioned on a respective side of said dice, said dice being shaken in said dome when said dome is depressed and subsequently released thereby facilitating random sides of said dice to be displayed wherein said motivational phrases on said random sides to be displayed to the user; and wherein said housing has a bottom wall and a perimeter wall extending upwardly therefrom, said perimeter wall having a distal edge with respect to said bottom wall to define an opening into said housing, said perimeter wall having an inwardly facing surface, said inwardly facing surface having a groove extending therein, said groove being spaced downwardly from said distal edge, said groove extending around an entire perimeter of said perimeter wall.

2. The assembly according to claim 1, wherein said lid has a top surface and a bottom surface, said opening extending through said top surface and said bottom surface, said lid including a pair of engagements, each of said engagements extending downwardly from said bottom surface, said bottom surface resting on said distal edge of said perimeter wall when said lid is positioned on said housing, each of said engagements engaging said groove for retaining said lid on said housing.

3. The assembly according to claim 2, wherein said dome has a lower edge and an interior surface, said interior surface being concavely arcuate with respect to said lower edge, said dome having a lip extending outwardly therefrom, said lip being aligned with said lower edge, said dome being positioned in said opening in said lid having said dome extending upwardly through said opening, said dome being comprised of a translucent material.

4. The assembly according to claim 3, wherein said biasing unit has a pair of legs angling downwardly from a central portion of said biasing unit, said lower edge of said dome resting on said central portion, each of said legs engaging said bottom wall of said housing, said central portion being urged toward said bottom wall of said housing when said dome is depressed, said legs biasing said central portion upwardly toward said lid when said dome is released.

5. The assembly according to claim 3, further comprising a gasket being positioned between said lip on said dome and said bottom surface of said lid, said gasket extending around a full circumference of said opening in said lid, said gasket being comprised of a resiliently compressible material, said lip being compressed against said gasket when said biasing unit biases said dome into said raised position.

6. A motivational phrase assembly being configured to display a variety of motivational phrases for enhancing well-being in a user, said assembly comprising:

a housing being positionable on a support surface, said housing having a bottom wall and a perimeter wall extending upwardly therefrom, said perimeter wall having a distal edge with respect to said bottom wall to define an opening into said housing, said perimeter wall having an inwardly facing surface, said inwardly facing surface having a groove extending therein, said groove being spaced downwardly from said distal edge, said groove extending around an entire perimeter of said perimeter wall;

a lid being attached to said housing, said lid having an opening extending therethrough, said lid having a top surface and a bottom surface, said opening extending through said top surface and said bottom surface, said lid including a pair of engagements, each of said engagements extending downwardly from said bottom surface, said bottom surface resting on said distal edge of said perimeter wall when said lid is positioned on said housing, each of said engagements engaging said groove for retaining said lid on said housing;

a dome being movably disposed on said housing, said dome being depressable into a depressed position, said dome being biased into a raised position, said dome having a lower edge and an interior surface, said interior surface being concavely arcuate with respect to said lower edge, said dome having a lip extending outwardly therefrom, said lip being aligned with said lower edge, said dome being positioned in said opening in said lid having said dome extending upwardly through said opening, said dome being comprised of a translucent material;

a biasing unit being positioned within said housing, said biasing unit engaging said dome, said biasing unit defining a floor of said dome, said biasing unit biasing said dome into said raised position, said biasing unit having a pair of legs angling downwardly from a central portion of said biasing unit, said lower edge of said dome resting on said central portion, each of said legs engaging said bottom wall of said housing, said central portion being urged toward said bottom wall of said housing when said dome is depressed, said legs biasing said central portion upwardly toward said lid when said dome is released;

a pair of dice, each of said dice being positioned within said dome such that said dice are visible through said dome, each of said dice having indicia being printed thereon, said indicia comprising a plurality of unique motivational phrases, each of said motivational phrases being positioned on a respective side of said dice, said dice being shaken in said dome when said dome is depressed and subsequently released thereby facilitating random sides of said dice to be displayed wherein said motivational phrases on said random sides to be displayed to the user, each of said dice resting on said central portion of said biasing unit; and a gasket being positioned between said lip on said dome and said bottom surface of said lid, said gasket extending around a full circumference of said opening in said lid, said gasket being comprised of a resiliently compressible material, said lip being compressed against said gasket when said biasing unit biases said dome into said raised position.

* * * * *